United States Patent [19]

Grier-Idris

[11] Patent Number: 4,662,005

[45] Date of Patent: May 5, 1987

[54] CONFORMABLE SURGICAL FACE MASK

[75] Inventor: Carletta Grier-Idris, College Park, Ga.

[73] Assignee: Kimberly-Clark Corporation, Neenah, Wis.

[21] Appl. No.: 638,074

[22] Filed: Aug. 6, 1984

[51] Int. Cl.[4] ..... A61B 19/00; A62B 23/00

[52] U.S. Cl. ..... 2/9; 128/206.19

[58] Field of Search ..... 128/206.12, 206.13, 128/206.19, 206.28, 206.21, 206.24; D2/236; 2/9, 68, 174, 196, 206; 525/98

[56] References Cited

U.S. PATENT DOCUMENTS

| | | | |
|---|---|---|---|
| Re. 28,102 | 8/1974 | Mayhew . | |
| 1,035,217 | 8/1912 | McQuary, Jr. | 2/206 |
| 1,144,121 | 6/1915 | Guinzburg | 2/236 |
| 2,012,505 | 8/1935 | Goldsmith . | |
| 2,039,681 | 5/1936 | Chatfield . | |
| 2,081,779 | 5/1937 | Titus . | |
| 2,191,325 | 2/1940 | Skillen | 2/174 |
| 2,281,744 | 5/1942 | Brunner | 128/206.13 |
| 2,494,406 | 1/1950 | Reitano . | |
| 2,634,725 | 4/1953 | Presti | 2/174 X |
| 3,170,461 | 2/1965 | Watts, Jr. . | |
| 3,802,429 | 4/1974 | Bird . | |
| 3,834,384 | 9/1974 | Raines . | |
| 3,884,227 | 5/1975 | Lutz et al. . | |
| 3,890,966 | 6/1975 | Aspelin et al. . | |
| 3,960,096 | 6/1976 | Zobel | 2/9 |
| 3,971,369 | 7/1976 | Aspelin et al. . | |
| 3,971,373 | 7/1976 | Braun . | |
| 3,985,132 | 10/1976 | Boyce et al. | 128/206.19 |
| 4,259,220 | 3/1981 | Bunnelle et al. | 525/98 |

FOREIGN PATENT DOCUMENTS

| | | | |
|---|---|---|---|
| 893614 | 4/1962 | United Kingdom | 128/206.19 |
| 2086734 | 5/1982 | United Kingdom . | |

*Primary Examiner*—Werner H. Schroeder
*Assistant Examiner*—Andrew M. Falik
*Attorney, Agent, or Firm*—William D. Herrick

[57] ABSTRACT

A generally pouch-like conformable face mask especially suitable for surgical use. The face mask includes a generally rectangular body portion formed from a filtration medium and having top and bottom edge portions and a pair of opposed side portions. To provide the face conforming features and a substantially gas-tight seal between the mask and the face of the wearer, an elastically extendable material is located at the periphery of the side and bottom edge portions of the generally rectangular body portion, mask to gather into a pouch or cup-like configuration. This permits the wearer to don the face mask by engaging the pouch-like portion with the chin fitting within the pouch while the body portion covers the mouth and nose of the wearer.

6 Claims, 5 Drawing Figures

CONFORMABLE SURGICAL FACE MASK

TECHNICAL FIELD

The present invention relates to face masks and, more particularly, to face-conforming surgical face masks.

BACKGROUND ART

Face masks are generally intended to provide protection to a wearer thereof or to someone else in the wearer's presence. Thus, face masks containing porous material are frequently worn by those who seek to avoid inhalation of particulate matter, and masks containing an absorbent, or "gas" masks, are often worn to avoid inhalation of toxic or generally deleterious fumes. Surgical masks, however, are generally worn to avoid contamination of a patient during a surgical procedure due to bacteria exhaled by those present in the operating room.

The primary function, therefore, of a suitable surgical mask is to filter exhaled air and, preferably, also to filter inhaled air. To adequately accomplish these objects, the surgical mask should provide a tight fit surrounding the nose and mouth of the wearer. A well designed surgical mask should also, preferably, minimize condensation of moisture within the mask and/or provide a means for removal or exit for such moisture while including a "face-tight" seal sufficient to prevent exhaled air from taking any exit avenue other than through the filtering medium from which the mask is constructed. Additionally, a suitable surgical mask should provide a comfortable fit so as not to distract the wearer. Finally, a preferred surgical mask is one which is easy to don, requiring minimal dexterity and time to properly fix its position.

DISCLOSURE OF INVENTION

The surgical mask of the present invention provides the aforementioned characteristics. Namely, the present invention provides a face-conforming surgical mask in the form of a pouch or cup-like, flexible face mask which produces a substantially gas-tight seal between the periphery of the mask and the face of the wearer so that all exhaled air passes through the mask. In addition, the mask is comfortable to the wearer and can be quickly and easily donned and removed.

The desirable features of the present invention result from a surgical mask which includes a generally rectangular body portion formed from a filtration medium, the body portion having top and bottom edge portions and a pair of opposed side portions. To provide the face conforming features of the present invention and the concomitant substantially gas-tight seal between the mask and the face of the wearer and also the means for facile fitting and locating the mask on the face of the wearer, an elastically extendable material provided by, preferably, at least one elastic member, is located at the periphery of the side and bottom edge portions of the generally rectangular body portion of filtration medium. The at least one elastic member, secured to the periphery of the edge portions while the member is in a distended state, causes the bottom and side portions of the mask to gather into a pouch- or cup-like configuration when the at least one elastic member assumes a relaxed state. The gathered pouch-like lower portion of the face mask permits the wearer to put on the mask by engaging the pouch-like portion with the lower jaw so that the chin fits within the pouch or cup-like portion of the mask while the body portion of the mask covers the mouth and nose of the wearer. A means for affixing the mask to a wearer's head may then be employed to secure the mask to the face of the wearer.

BRIEF DESCRIPTION OF THE DRAWINGS

FIG. 1A is a perspective view of an embodiment of the invention showing an oversize body member layer;

BEST MODE FOR CARRYING OUT THE INVENTION

Figure 1:
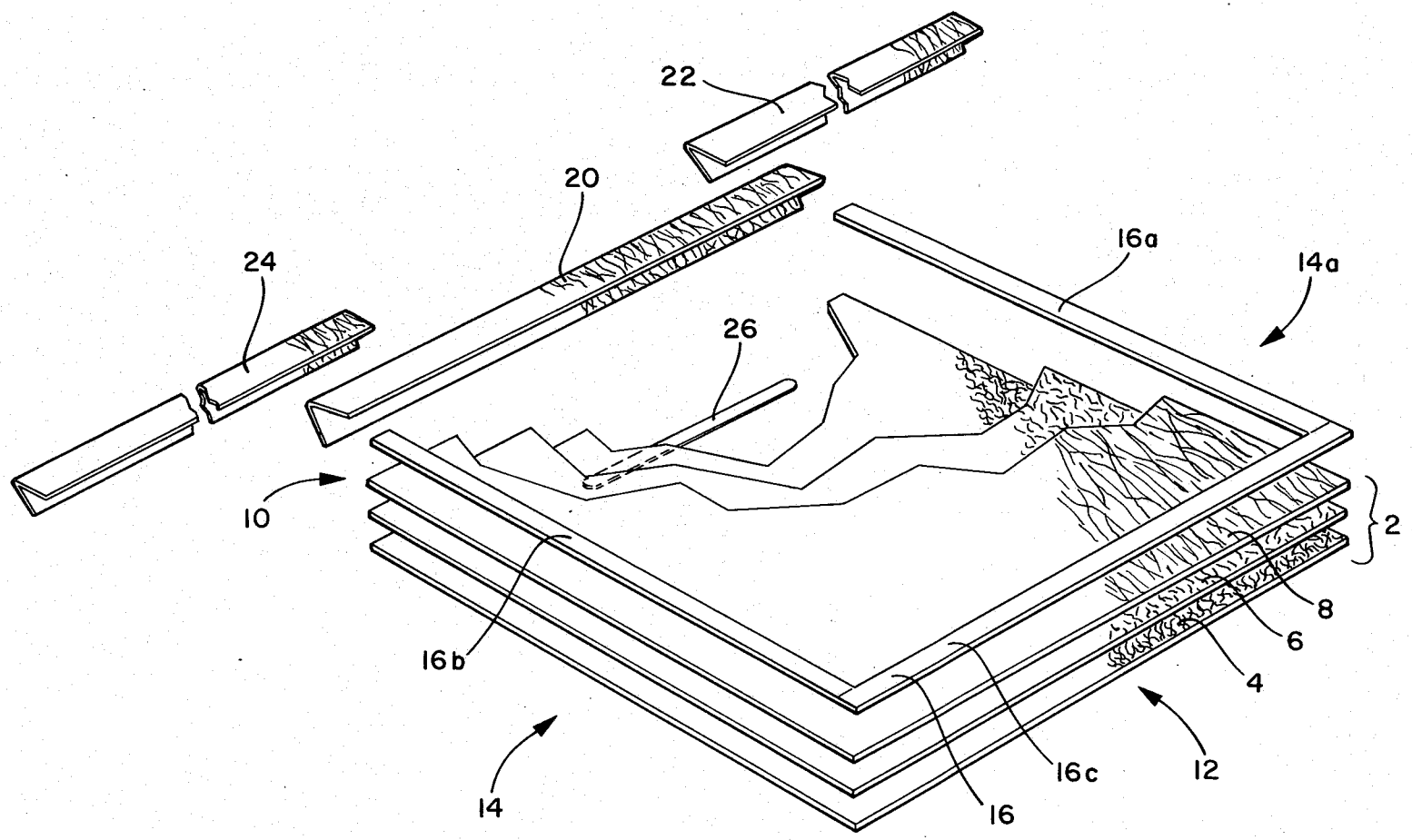
FIG. 1 is an exploded perspective view of a preferred embodiment of the present invention.

As shown in FIG. 1, an embodiment of the surgical mask of the present invention includes a flexible porous pad 2 formed from a bacteria filtering medium. The porous pad, which forms a body portion, has a generally rectangular or square shape. The filtration material is preferably a laminate of layers of a nonwoven air permeable material. Preferably, the laminate is formed from a spunbonded/melt-blown laminate which is provided with a cover sheet on an inner layer in contact with the face of the wearer. Thus, as illustrated in a preferred embodiment shown in FIG. 1, the porous pad 2 includes an outer layer 4 of a nonwoven spunbonded material, an intermediate layer 6 of a nonwoven melt-blown material and an inner layer 8 of a nonwoven cover stock, such as that formed from a cellulosic material or a cellulosic material in combination with synthetic fibers. Each of the layers of the laminate is generally rectangular and preferably coextensive with the other layers or outer layer 4 oversized and adapted to be folded over as shown in FIG. 1A.

The rectangular body portion formed from filtration material has an upper edge or edge portion 10, a lower edge or edge portion 12, and two opposed sides or side edge portions **14*a* and 14*b***.

Figure 5:
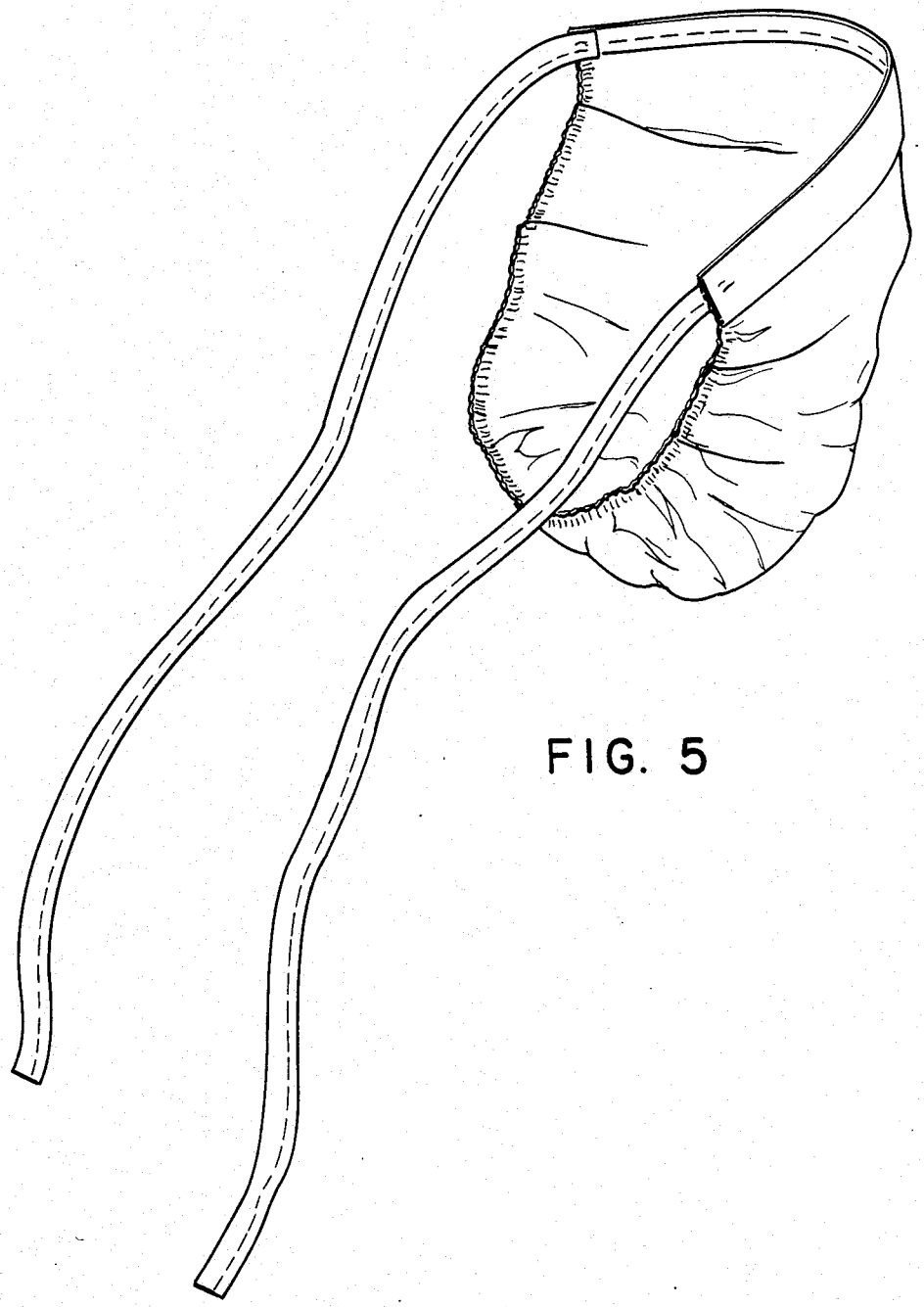
FIG. 5 is an isometric view of an embodiment of the invention.

To provide a pouch-like configuration to the mask, such as that shown in FIG. 5, there is located at the bottom edge 12 and side edges **14*a* and 14*b* an elastically extendable material preferably in the form of at least one elastic member 16. The elastic member may be a single member 16 of unitary construction, having a "U" or arcuate shape formed as three regions or may be formed as three separate elastic members 16*a* and 16*b* located at the side edge portions and 16*c* located at the bottom edge portion. The elastic member(s) 16 or 16*a*, 16*b* and 16*c* may be formed from any conventional elastically extendable material capable of withstanding sterilizing agents and techniques commonly employed therefor. When in the form of a strip of elastic material, the elastic member or members may be secured to one surface of porous pad 2, such as the periphery of outer layer 4 or the periphery of inner layer 8 (as shown in FIG. 1). Alternatively, the elastic member or members may be secured between intermediate layer 6 and either the outer or inner layer, 4 or 8, respectively, or between the intermediate layer 6 and both the inner and outer layers. The elastic member or members are applied to the peripheral edge portions of the porous pad 2** by any means commonly used to secure an elastically extendable material to a fabric, such as by use of a suitable adhesive or stitching with, preferably, elastic thread.

When the elastically extendable material is secured to the bottom and side edge portions of the body portion of the surgical mask, the elastic member or members are stretched to a distended state. In this state the lengths of each edge region or separate member 16*a*, 16*b*, 16*c* are approximately equal to the lengths of the edge portions to which the particular edge region of the member or members are affixed. To achieve the pouch-like configuration in which the sides and bottom edge portions of the body portion form a pouch-like configuration the elastic member or members employed should have a length in the relaxed state which is substantially shorter than their lengths in the distended state.

As an alternative to elastic strips which may be adhesively adhered or sewn to the peripheral edge portions of the porous pad, a self-adhering elasticizing material may be applied to the peripheral side and bottom edge portions of the body portion. Like the elastic member formed from strips of elastic material, the self-adhering elasticizing material may be applied at the periphery of either outer surface of layer 4 or layer 8 or may be placed intermediate inner layer 6 and one or both of layers 4 and 8. Materials suitable for use as the self-adhering elasticizing material generally include viscoelastic hot melt adhesive compositions such as that described in U.S. Pat. No. 4,259,220, incorporated herein by reference.

In many situations, layers 4, 6 and 8 will be laminated to one another such that there will be little tendency to separate or tear, particularly at the edges of the porous pad. In some embodiments of the present invention, the adhering elasticizing material, such as the viscoelastic hot melt adhesive described above, may be placed between the layers forming the porous pad. In other embodiments, such as where a strip of elastic material is affixed to the side and bottom edge portions of the main body portion of the mask by sewing, the stitches serve to bind the edges of the porous pad. In some embodiments it may be preferred to employ at least one binding strip along the bottom and side edge portions or along all of the edge portions of the mask to reduce any tendency which may exist for the layers to separate or the pad to tear. The binding strip may be formed from a strip or strips of material, preferably nonwoven material, folded along their longitudinal axes. The edge portions of the mask are then placed within the fold and the binding strip either sewn or adhesively secured to the edge portions.

The upper or top edge portion 10 of the substantially rectangular body portion of filtration material generally includes a binding strip 20 of the type described immediately above. That is, the binding strip is formed from a strip of nonwoven material which is folded on its longitudinal axis such that the fold receives the porous pad and is suitably secured therein, either with adhesive means or by stitching through both outer surfaces of the binding strip and the intermediate filtration material. As an alternative to placing the porous pad 2 within the fold formed in a binding strip 20, the latter may be secured on one surface of the porous pad by use of adhesive means or sewing the strip to the porous pad.

Figure 4:
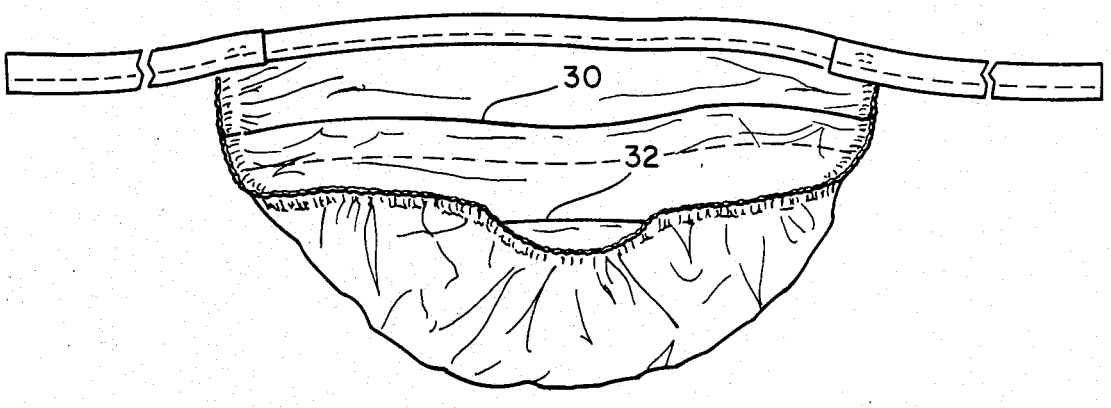
FIG. 4 is a rear view of the embodiment of the invention shown in FIG. 3.

A means for affixing the mask to or retaining the mask on the head of a wearer may be provided at the upper edge portion of the mask. As shown in FIGS. 1 and 4, this may take the form of separate tie strips 22 and 24 secured to the upper edge portion of the mask at the sides of the mask. The tie strips may be secured directly to the porous pad 2 or to a binding strip 20 affixed on or partly enclosing the upper edge portion 10. Alternatively, the affixing means may take the form of an oversized length of binding strip 20 of the same material and width as the binding strip described above which may be used such that the strip, when symmetrically placed, has a length extending laterally well beyond the side edges 14*a* and 14*b*, providing thereby ends to the binding strip equivalent to tie strips 22 and 24 which may be tied behind the head of the wearer. Generally, a length of binding strip on the order of about 25 to 33 inches in length, is suitable on a mask which has dimensions of approximately $6\pm1$ inches on a side. Like the binding strip 20, this last described embodiment, employing extended ends which serve as tie strips, may be arranged such that the filtration pad is secured within the fold of the binding strip or the binding strip may be secured to the top edge portion of the porous pad by stitching the binding strip to the pad in contact with either surface 4 or 8. Another embodiment includes securing separate tie strips at or adjacent the upper edge portion to a binding formed by using either an outer layer 4 or an inner layer 8 having dimensions larger than the other layers of the substantially rectangular pad of filtering material. The oversized layer may be folded back upon itself to receive the remaining layers within the fold formed in the oversized layer. All layers may then be secured at their edge portions, either with suitable adhesive means placed between the overlapping folded edge portion and the surface which it adheringly contacts or by stitching through the edge portions of the layers and the folded overlapping portion. Whether the tie strips used as means for affixing the mask to the head of a wearer are formed from an oversized strip of binding material or attached separately, when formed from folded material, the fold in the tie strip is, preferably, sewn or adhesively closed.

A nose piece 26 may be provided at the upper edge portion of the body portion of the mask with a thin strip of bendable or deformable material such as, for instance, aluminum or thin gauge steel. The nose piece may be enclosed within the fold of the binding strip and maintained in position between the fold and stitching formed through the binding strip or those portions of the body portion serving as the binding strip (as where an oversized layer of the porous pad is folded back on itself to overlappingly enclose the edge portions of the other layers) and the upper edge portions of the body portion. Alternatively, the nose piece may be secured adhesively, such as between the binding strip and the outer surface of one of the layers 4 or 8 of the pad 2. An example of how this may be accomplished is to attach the nose piece to the adhesive side of an oversized piece of pressure sensitive tape which is adhesively fixed to an outer surface of the porous pad or inner surface of a binding strip such that the metal strip is enclosed between the tape and either the porous pad or binding strip. Alternatively, a double-faced pressure sensitive adhesive may be used to locate the nose piece of the positions described above. A strip of cover material or spunbonded material may then be placed over the free adhesive surface of the double faced tape. Another alternate embodiment employs the metallic nose piece strip with a self-adhering back provided by a suitable adhesive applied to a surface thereof.

Figure 2:
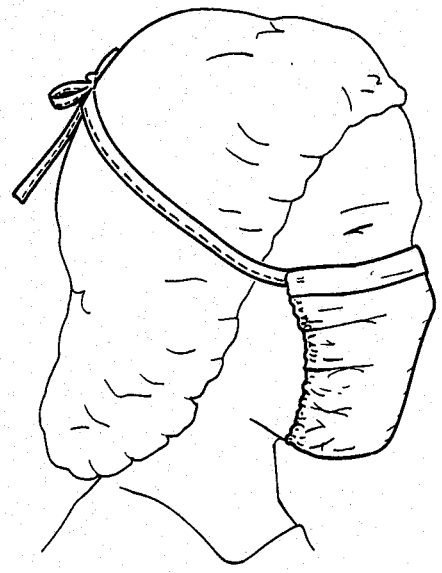
FIG. 2 is a side view of a preferred embodiment of the present invention as worn.
Figure 3:
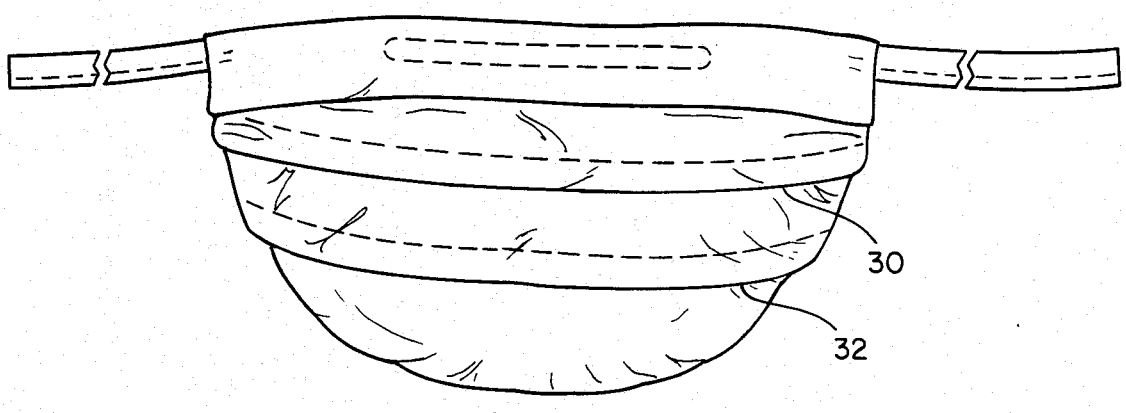
FIG. 3 is a front view of an embodiment of the invention.

The main body portion of the mask may also be provided with several folds or pleats, preferably from 1 to 3 pleats, arranged substantially parallel to the upper edge of the generally rectangular body portion. These folds assist in several functions. Specifically, the provision of at least one fold arranged such that the bottom edge portion of the inner layer 8 contacts or lies in close proximity to the center or upper edge portion of the main body portion of the mask allows the lower portion of the mask to assume a cup or pouch-shaped configuration, illustrated in FIG. 5, which may be slipped over the chin of the wearer with the proper orientation, as shown in FIG. 2. Provision of several additional horizontal folds, as shown in FIGS. 3 and 4, provides a pocket after donning the mask to facilitate air exchange. Additionally, the mask may be folded to form horizontal pleats, such as 30 and 32, which unfold when slipped over the face of the wearer to provide sufficient room and adapt to the facial features of the wearer.

The operation and construction of the abovedescribed invention will be apparent from the foregoing description and the accompanying drawings. While particular embodiments have been shown and described, it will be obvious that various changes and modifications may be made therein without departing from the spirit and scope of the invention as defined in the following claims.

I claim:

1. A generally pouch-like, flexible face mask comprising:

a generally rectangular body portion formed from a air permeable filtration medium comprised of a plurality of coextensive layers of nonwoven material one of which is oversized, said body portion having top and bottom edge portions and a pair of opposed side edge portions wherein said oversized layer is folded back upon itself to receive the remaining layers within the fold formed in the oversize layer and all layers are secured within the overlap portion;

means for retaining the mask on the head of a wearer; and means for conforming the face mask to the face of a wearer comprising an elastic member formed from an elastically extendable material secured to one surface along substantially the entire periphery of said bottom and side edge portions only of said body portion, said elastic member having a length in a relaxed state substantially shorter than the edge portions to which it is secured and a length in an extended state approximately equal to the edge portions to which it is attached, providing thereby a continuous, gathered, face-engaging pouch-like nose and mouth cover portion when the elastically extendable material is in a relaxed condition, said pouch-like nose and mouth cover portion adapted to conform to the lower portion of the face of a wearer and produce a substantially gas-tight seal between the mask and the face of the wearer.

2. The flexible face mask according to claim 1 wherein said elastically extendable material comprises at least one elastic member.

3. The flexible face mask according to claim 2 wherein said at least one elastic member comprises one elastic member.

4. The flexible face mask according to claim 2 wherein said at least one elastic element comprises three elastic elements secured to the bottom and opposed side edge portions, respectively.

5. The flexible face mask according to claim 2 wherein said at least one elastic member comprises a viscoelastic hot melt adhesive material.

6. The flexible face mask according to claim 1 wherein a deformable nose piece is located at the upper edge portion of said main body portion.

* * * * *

UNITED STATES PATENT AND TRADEMARK OFFICE

CERTIFICATE OF CORRECTION

PATENT NO. : 4,662,005

DATED : May 5, 1987

INVENTOR(S) : Carletta Grier-Idris

It is certified that error appears in the above—identified patent and that said Letters Patent is hereby corrected as shown below:

Title page:

In the Abstract, line 10, "mask" should read --which causes the mask--

Column 5, line 20, "abovede-" should read --above-de--

Signed and Sealed this

Eighth Day of March, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,662,005

DATED : May 5, 1987

INVENTOR(S) : Carletta Grier-Idris

It is certified that error appears in the above-identified patent and that said Letters Patent is hereby corrected as shown below:

In the drawing, FIGURE 1A, should appear as shown below.

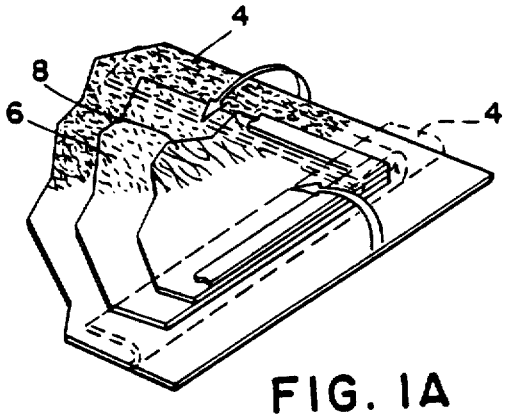

FIG. 1A

Signed and Sealed this

Fourteenth Day of February, 1989

*Attest:*

DONALD J. QUIGG

*Attesting Officer*

*Commissioner of Patents and Trademarks*